US005562314A

United States Patent [19]

Wheatland et al.

[11] Patent Number: 5,562,314

[45] **Date of Patent: *Oct. 8, 1996**

[54] DOOR LATCH ASSEMBLY WITH BACKSET ADJUSTMENT

[75] Inventors: Graham Wheatland, Richmond; Hagen Dietrich, White Rock, both of Canada

[73] Assignee: Masco Corporation of Indiana, Taylor, Mich.

[ * ] Notice: The term of this patent shall not extend beyond the expiration date of Pat. No. 5,364,138.

[21] Appl. No.: 339,441

[22] Filed: Nov. 14, 1994

Related U.S. Application Data

[63] Continuation-in-part of Ser. No. 60,102, May 10, 1993, Pat. No. 5,364,138.

[51] Int. Cl.[6] ..... E05C 1/16

[52] U.S. Cl. ..... 292/1.5; 137/165; 137/337

[58] Field of Search ..... 292/1.5, DIG. 60, 292/337, 137, 165

[56] References Cited

U.S. PATENT DOCUMENTS

| | | | |
|---|---|---|---|
| 1,661,454 | 3/1928 | Wilson . | |
| 3,786,578 | 1/1974 | Hufford et al. . | |
| 4,372,594 | 2/1983 | Gater . | |
| 4,446,707 | 5/1984 | Mullich et al. . | |
| 4,468,059 | 8/1984 | Nelson et al. . | |
| 4,470,278 | 9/1984 | Hale et al. . | |
| 4,564,229 | 1/1986 | Mullich et al. . | |
| 4,593,542 | 6/1986 | Rotondi et al. . | |
| 4,602,490 | 7/1986 | Glass et al. . | |
| 4,615,549 | 10/1986 | couture . | |
| 4,639,025 | 1/1987 | Fann et al. . | |
| 4,656,849 | 4/1987 | Rotondi et al. . | |
| 4,664,433 | 5/1987 | Solovieff . | |
| 4,708,379 | 11/1987 | Ching . | |
| 4,725,086 | 2/1988 | Shen . | |
| 4,729,586 | 3/1988 | Fang . | |
| 4,752,090 | 6/1988 | Lin . | |
| 4,759,576 | 7/1988 | Ching . | |
| 4,772,055 | 9/1988 | Fang . | |
| 4,834,432 | 5/1989 | Smallegan et al. . | |
| 4,840,412 | 6/1989 | Shen . | |
| 4,840,413 | 6/1989 | Shen . | |
| 4,895,404 | 1/1990 | Toledano | 292/1.5 X |
| 4,902,057 | 2/1990 | Ching . | |
| 4,921,290 | 5/1990 | Dietrich . | |
| 4,950,008 | 8/1990 | Fang . | |
| 4,957,315 | 9/1990 | Lin . | |
| 4,979,768 | 12/1990 | Marotto et al. . | |
| 5,149,151 | 9/1992 | Shen | 292/1.5 |
| 5,152,558 | 10/1992 | Smith et al. . | |

*Primary Examiner*—Philip C. Kannan

*Attorney, Agent, or Firm*—Leon E. Redman; Malcolm L. Sutherland

[57] ABSTRACT

A latch assembly for mounting in a bore extending in from a side edge of a door has a backset adjustment for different distances between rotational axis of a handle or keylock and the side edge of the door. The bolt has a concentric aperture into which a bolt adjuster slidably mates with a close tolerance to prevent lateral movement between the bolt and the bolt adjuster. The latch assembly comprises a casing assembly having a bolt assembly longitudinally reciprocal therein between a retracted position and an extended position, the bolt assembly including a bolt with a cylindrical aperture therein, the bolt rotatable and reciprocal relative to a non-rotational cylindrical bolt adjuster and having a sliding fit thereon. A helical groove in one of the bolt or the bolt adjuster engages with a projection of the other of the bolt or bolt adjuster. The casing assembly is in two parts with a non-rotational rear casing integral with a hollow cylindrical portion with a non-helical serpentine shaped slot, and a forward hollow cylindrical casing rotatable and slidable about the front portion of the rear casing, with the forward casing having an internal protrusion to engage in the non-helical serpentine shaped slot. Thus the forward casing and bolt can be rotated together but through significantly different patterns of movement to change the backset with the bolt moving longitudinally ahead of the forward casing midway through simultaneous rotation of both.

10 Claims, 6 Drawing Sheets

DOOR LATCH ASSEMBLY WITH BACKSET ADJUSTMENT

This is a Continuation-in-Part of application Ser. No. 08/060,102 filed May 10, 1993 and now U.S. Pat. No. 5,364,138.

TECHNICAL FIELD

The present invention relates to a latch assembly for mounting in a bore extending in from a side edge of a door and operable by handles on opposing sides of the door. The latch assembly has a backset adjustment, the backset being the distance from the side edge of the door to a rotational axis of the handles or a keylock.

BACKGROUND OF THE INVENTION

Door latch assemblies are frequently made with a backset adjustment. The two standard backset dimensions for doors are 2-⅜ inches and 2-¾ inches. A latch assembly which is suitable for both backset dimensions, avoids the necessity of retailers stocking different latch assemblies. Furthermore, purchasers are relieved of the requirement to measure the backset before purchasing a latch assembly. In the past a latch assembly with a backset adjustment had an arrangement wherein the rotational spindle for the handles could be located at one of two positions in the casing assembly. One such example of this arrangement is shown in U.S. Pat. No. 4,921,290 which shows two spindle positions in the latch assembly. The spindle may be moved between these two positions to adjust the backset.

Another example of a latch assembly with a backset adjustment is shown in U.S. Pat. No. 4,664,433. This patent discloses a latch assembly which includes a bolt assembly having two parts and a casing assembly in two parts. The forward or front bolt part and front case part rotate and slide one within the other through a half revolution. The same helical longitudinal movement of both the front bolt part and front case part is required to change the backset. In this patent a rotatable front casing has a helical groove therein with a protrusion on a non-rotatable back casing engaging this helical groove. A hollow forward bolt part is shown into which an integral hollow bolt extension and bolt adjuster is received. A pin extends through the hollow forward bolt part to engage a helical slot in the bolt adjuster. Thus, when the bolt part rotates with the front casing, both move outward or inward in the same helical movement to change the backset.

With the bolt part and the casing part moving along the same helical path they ideally retain the same relative position as they move from one backset position to another. Flats in the two extreme positions of the casing grooves cause the bolt to commence helical movement either slightly ahead or slightly behind the helical casing movement at the very beginning of the movement from one backset position to the other to prevent misalignment which could cause the bolt to fall out of the thin opening in the face plate and jam. However, due to tolerances between the moving parts it still is possible for the bolt part to fall behind the casing part after simultaneous helical movement has begun which in turn can result in the bolt part falling out of the face plate and jamming.

Another problem with this arrangement is space between the cylindrical portion of the bolt adjuster and the non-cylindrical hollow interior of the bolt is sufficient to allow considerable undesirable lateral movement of the bolt adjuster within the hollow interior of the bolt part. Consequently, the undesirable lateral movement of the bolt part can cause deflection which in some cases may result in jamming of the bolt, the latch mechanism becoming stiff or the bolt not engaging the strike plate in the door frame.

SUMMARY OF THE INVENTION

It is an object of this invention to eliminate the possibility of the bolt jamming during a change of backset.

It is an object of this invention to eliminate the possibility of the bolt part movement falling behind the casing part movement.

It is an object of this invention to advance the movement of the bolt part relative to the casing part at not only the beginning of a backset change but also during the middle of a backset change movement.

It is a further object to so advance the movement of the bolt part whether the backset is changed from short to long or vice versa.

It is a yet further object to reduce the number of parts and manufacturing costs of a door latch assembly with back set adjustment while achieving the above advantages.

In accordance with the present invention a latch assembly includes a two part casing with a front part rotatable and slidable on a fixed rear part, a serpentine non-helical shaped slot is provided in the rear part casing to constrain a protrusion on the front part casing so that when the front part casing is rotated 180° through a serpentine non-helical pattern the backset position of the front part of the casing is changed. A thick walled bolt is provided with a cylindrical hollow interior into which a solid or tubular cylindrical bolt adjuster having a complimentary configuration closely fits. Close tolerances are provided between the bolt and the mated bolt adjuster thus there is no space for lateral movement of the bolt relative to the bolt adjuster. The solid bolt adjuster has a helical groove extending at least 180° around the cylindrical surface of the solid bolt adjuster and a single bolt guide pin projects internally and engages the helical groove. The tubular bolt adjuster has a protuberance for threadable engagement with a helical groove formed in the inner cylindrical wall of the bolt and extending at least 180° therein. The bolt and the front part casing rotate together but with significantly different movements in different patterns, one movement helical and the other non-helical serpentine, to change the backset.

The present invention more particularly provides a latch assembly having a backset adjustment for mounting within a bore extending in from a side edge of a door and operable by a rotatable operator such as a handle or keylock from one side of the door, the handle or keylock positioned on a rotational axis, the latch assembly comprising a casing assembly for mounting in the bore of a door, the casing assembly having a bolt assembly longitudinally reciprocal therein between a retracted position and an extended position, the bolt assembly including a thick walled bolt with a cylindrical aperture therein, the bolt rotatable and reciprocal relative to a complementarily configured non-rotational solid or tubular cylindrical bolt adjuster and having a sliding fit thereon, either the bolt having an internal projection engageable in a helical groove of the bolt adjuster or the bolt adjuster having an external projection engageable in a helical groove in the bolt, a bolt extension connected at one end to the bolt adjuster and reciprocal with the bolt assembly, a cam actuating means connected to the other end of the bolt extension, the cam actuating means having a pivot connection coaxial with the rotational axis of the handle or keylock, the casing assembly including a non-rotatable rear casing with a back portion containing a rotational retaining means for the cam actuating means, the back portion of the rear casing integral with the front hollow cylindrical portion with a non-helical serpentine shaped slot extending for at least 180° therearound, a forward hollow cylindrical casing rotatable and slidable about the front portion of the rear casing, the forward casing having an internal protrusion engageable in the non-helical serpentine shaped slot of the rear casing, and the forward casing rotatably engaging the bolt such that the forward casing and bolt are rotatable through different patterns of movement to change the backset with the longitudinal movement of the bolt advanced relative to the longitudinal movement of the casing not only at the beginning but also the middle of a backset change movement in both directions.

A plastic guide having an opening complimentary to the configuration of the bolt significantly lengthens the area of contact with the bolt and further reduces the possibility of the bolt disengaging from the face plate and jamming during a backset movement.

BRIEF DESCRIPTION OF THE DRAWINGS

In drawings which illustrate embodiments of the present invention.

DESCRIPTION OF THE PREFERRED EMBODIMENT

Figure 1:
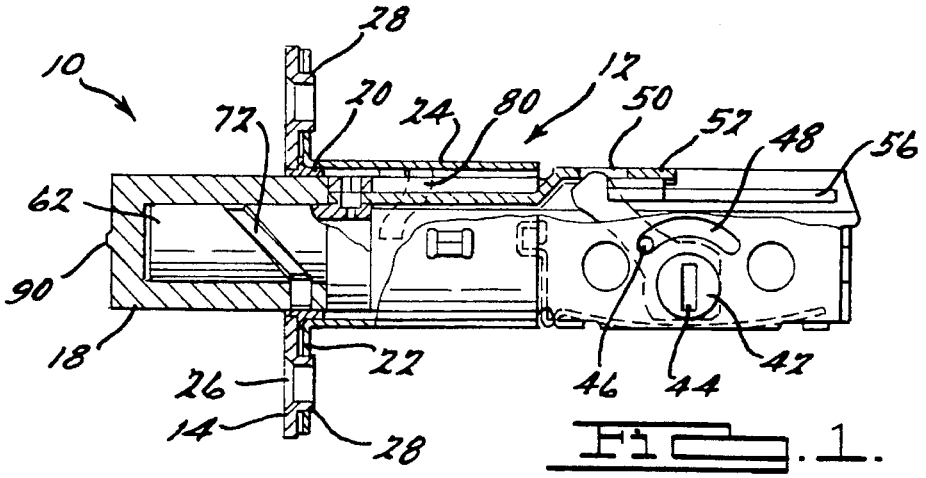
FIG. 1 is a longitudinal partial sectional view showing a latch assembly according to the present invention with a solid bolt adjuster, a short dimension backset and with the bolt in the extended position.
Figure 2:
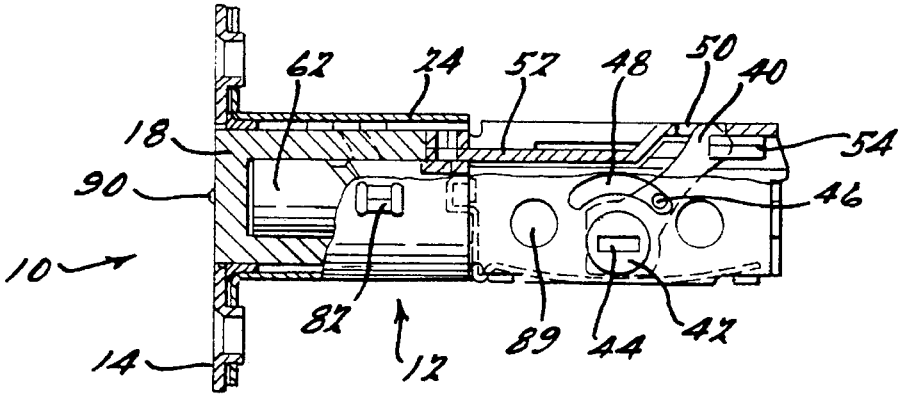
FIG. 2 is a longitudinal partial sectional view showing the latch assembly of FIG. 1 with the bolt in the retracted position.
Figure 3:
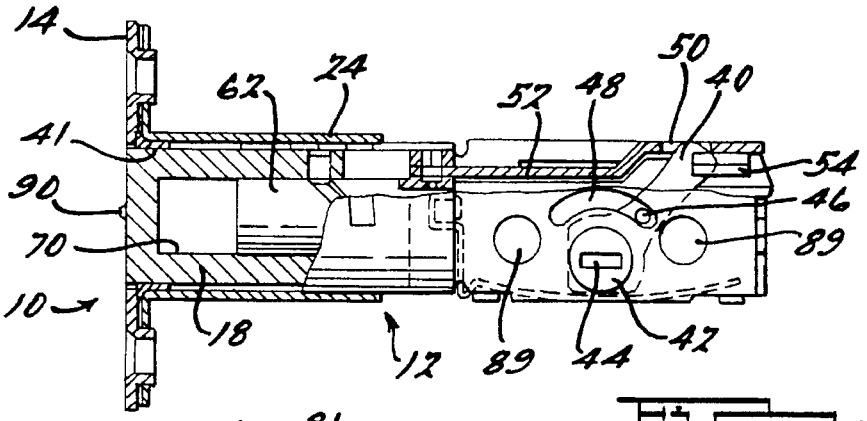
FIG. 3 is a longitudinal partial sectional view showing the latch assembly of FIG. 1 with a long dimension backset and the bolt in the retracted position.
Figure 5:
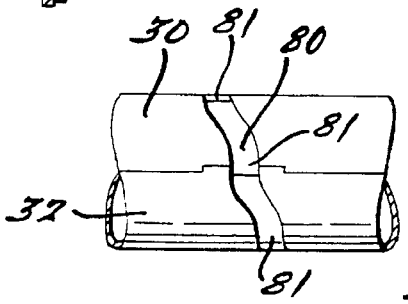
FIG. 5 is a top plan view of a portion of the rear casing showing the serpentine shaped slot.
Figure 13:
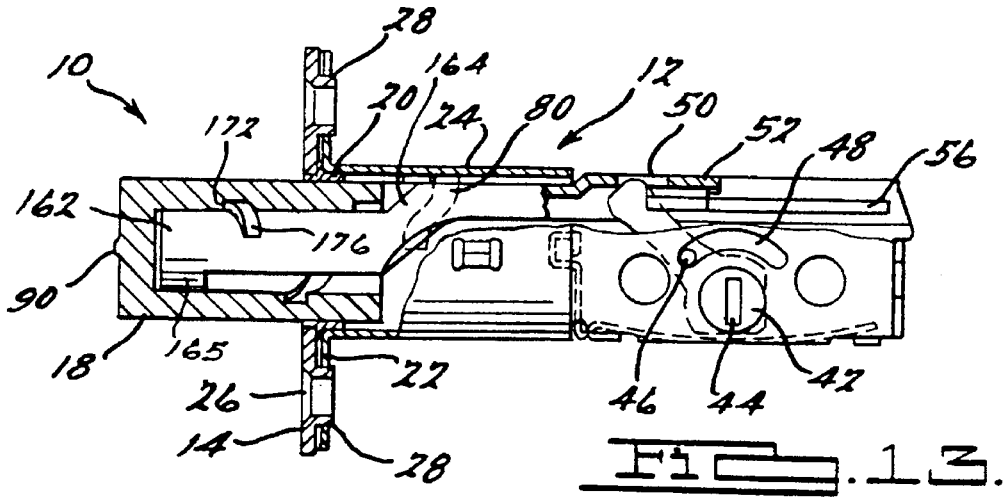
FIG. 13 is a longitudinal partial sectional view showing a latch assembly according to the present invention with a tubular bolt adjuster, a short dimension backset, and with the bolt in the extended position.
Figure 14:
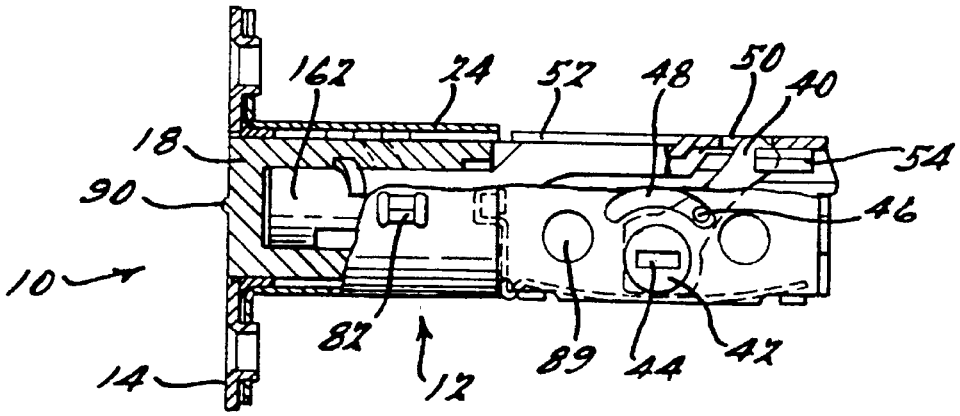
FIG. 14 is a longitudinal partial sectional view showing the latch assembly of FIG. 13 with the bolt in the retracted position.
Figure 15:
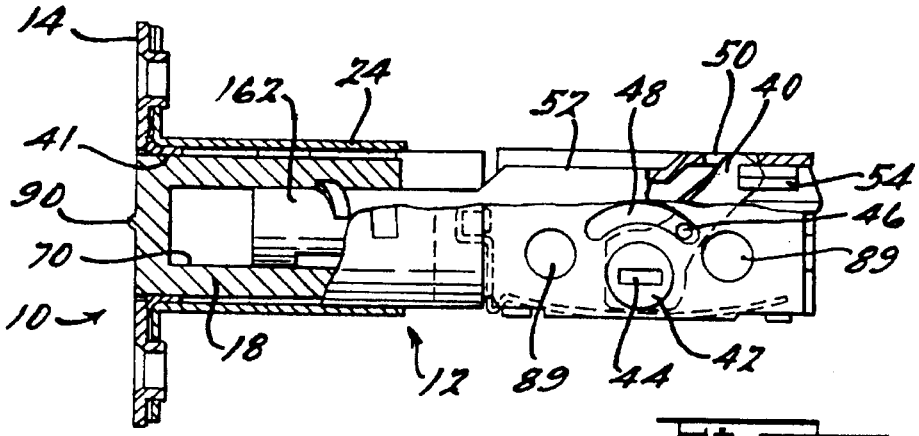
FIG. 15 is a longitudinal partial sectional view showing the latch assembly of FIG. 13 with a long dimension backset and the bolt in the retracted position.

Referring to the drawings, a latch or bolt assembly 10 is illustrated for mounting within a bore extending in from a side edge of a door. In FIGS. 1 and 13 a bolt assembly 10 is shown with a bolt 18 in an extended position projecting from within a casing assembly 12. In FIGS. 2 and 14 the bolt assembly 10 is shown with the bolt 18 in a retracted position. FIGS. 1, 2, 13 and 14 show a short dimension backset between a face plate 14 for mounting the latch assembly 10 on a side edge of the door and a spindle slot 44 that receives a spindle 16 (FIGS. 4 and 16) onto which are attached rotatable operators such as handles or keylocks (not shown) mounted on the face or faces of the door for operation of the latch assembly. FIGS. 3 and 15 show the bolt assembly 10 adjusted for a long dimension backset.

Figure 4:
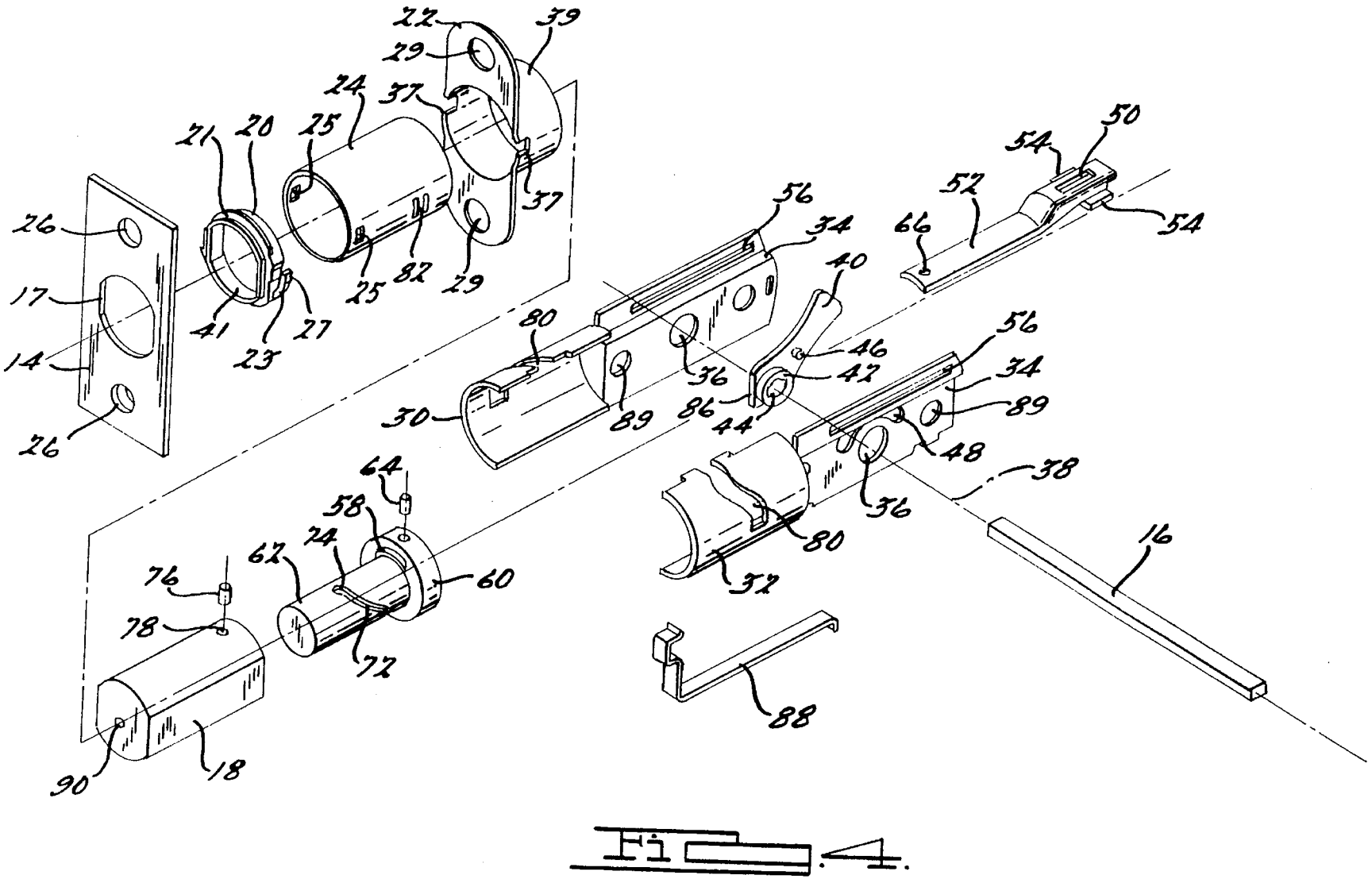
FIG. 4 is an exploded view showing the various components of the latch assembly of FIG. 1.
Figure 6:
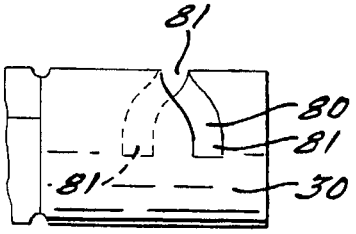
FIG. 6 is a left side elevation of a portion of the rear casing halves showing one side of the serpentine slot.
Figure 7:
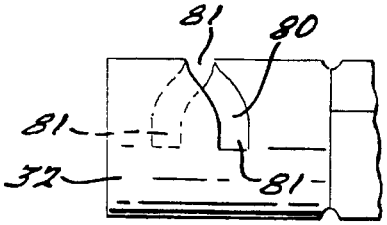
FIG. 7 is a right side elevation of a portion of the rear casing halves showing the side of the serpentine slot opposite that shown in FIG. 6.
Figure 8:
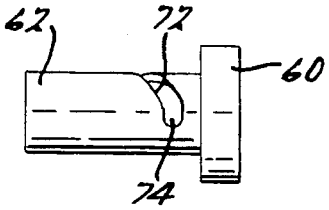
FIG. 8 is a bottom plan view of the bolt adjuster of FIG. 1 showing the helical groove and one of the two notches therein.
Figure 9:
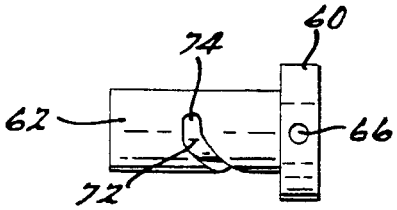
FIG. 9 is a top plan view of the bolt adjuster of FIG. 1 showing the helical groove and the other of the two notches therein.
Figure 16:
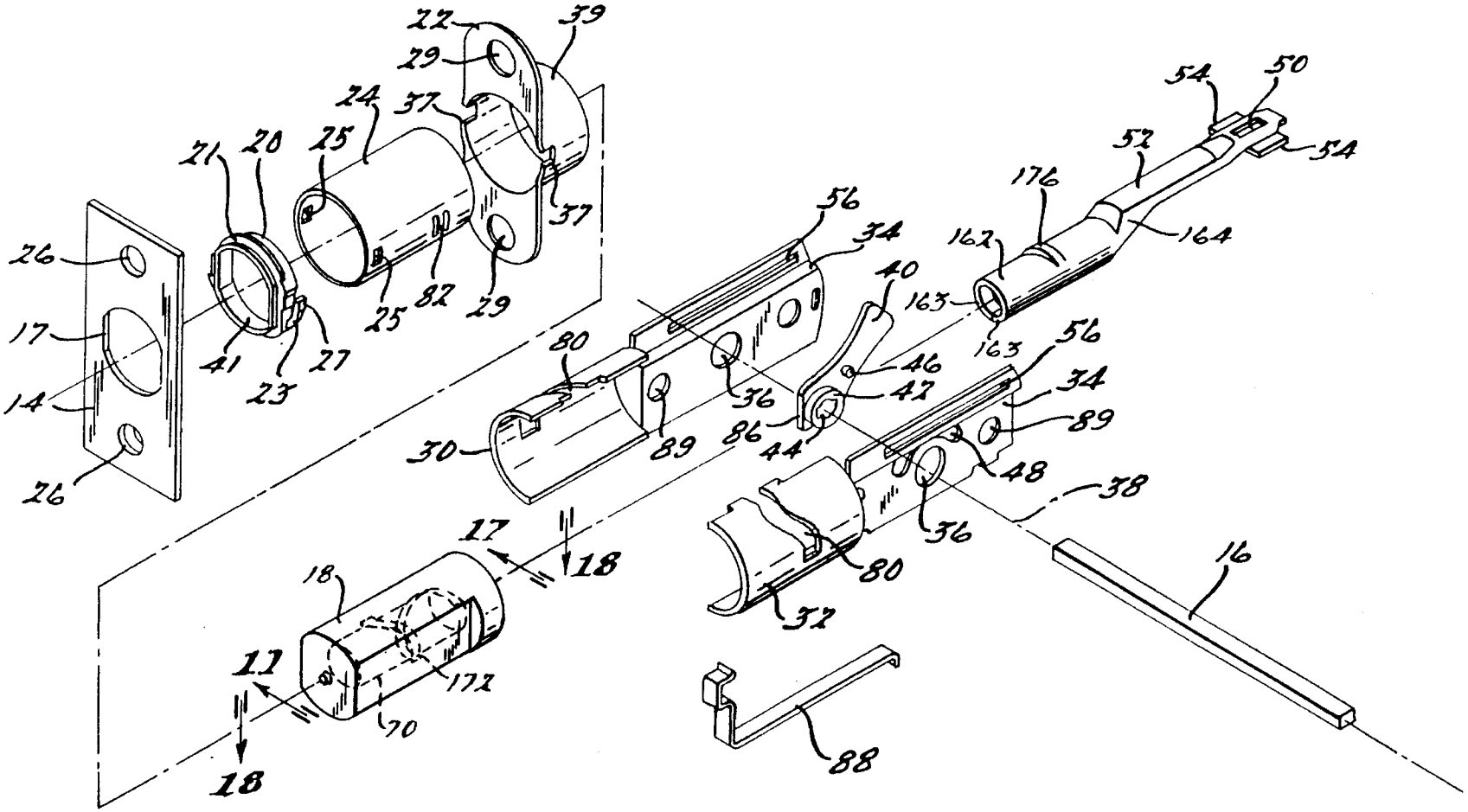
FIG. 16 is an exploded view showing the various components of the latch assembly of FIG. 13.
Figure 17:
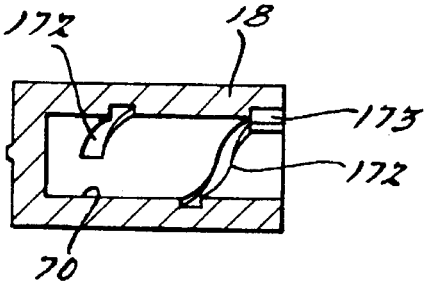
FIG. 17 is a sectional view of the bolt of FIG. 16 along line 17—17 showing the helical groove therein.
Figure 18:
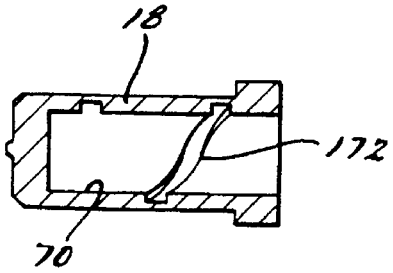
FIG. 18 is a sectional view of the bolt of FIG. 16 along line 18—18 showing the helical groove therein.

The face plate 14 has a center aperture 17 for a bolt 18 to reciprocate therein. The center aperture 17, which can be seen in FIGS. 4 and 16, is round with two flat sides to exactly match the cross-section configuration of the bolt 18. A plastic guide 20 fits within the aperture 17 of the face plate 14 and also has a cross-sectional aperture to exactly match the bolt 18. The plastic guide 20 provides smooth movement of the bolt 18 and acts as a bearing surface. The plastic guide 20 is sandwiched between the face plate 14 which is connected to a flange member 22 of a forward hollow cylindrical latch casing 24. The face plate 14 has attachment holes 26 on each side of the aperture 17 which have collars 28 that fit into matching holes 29 in the flange 22 of the forward latch casing 24. The collars 28 may be spiked to hold the face plate 14 to the flange 22 of the forward latch casing 24 and retain the plastic guide 20 in position. With the opposing flat surfaces of the bolt 18 engaged by the corresponding flats in the aperture 17 of the face plate 14, rotation of the face plate 14 causes the bolt 18 to rotate with the forward latch casing 24.

Referring to FIGS. 1–4 and 11–16, the plastic guide 20 is provided with upper and lower guide flanges 21 that abut the front edge of cylindrical casing 24 and the rear edge of aperture 17 of face plate 14. Resilient guide fingers 23 extend radially outwardly from a central portion of guide ring 20. Guide fingers 23 are generally arcuate and are spaced away from the central portion of the guide ring 20 to allow the fingers 23 to flex inwardly as the guide ring 20 is inserted into the front opening of cylindrical casing 24. Upon full insertion guide snaps 27 which protrude outwardly from the free end of each finger 23 are received in opposing rectangular snap-in apertures 25 provided adjacent the front opening of cylindrical casing 24. Rectangular openings or notches 37 are formed on opposite sides of the front of flange member 22 extending into sleeve 39 to accommodate the snap tabs 27 with the guide ring 20 sandwiched between rectangular face plate 14 and forward casing 24 as shown in FIGS. 4 and 16.

Figure 10:
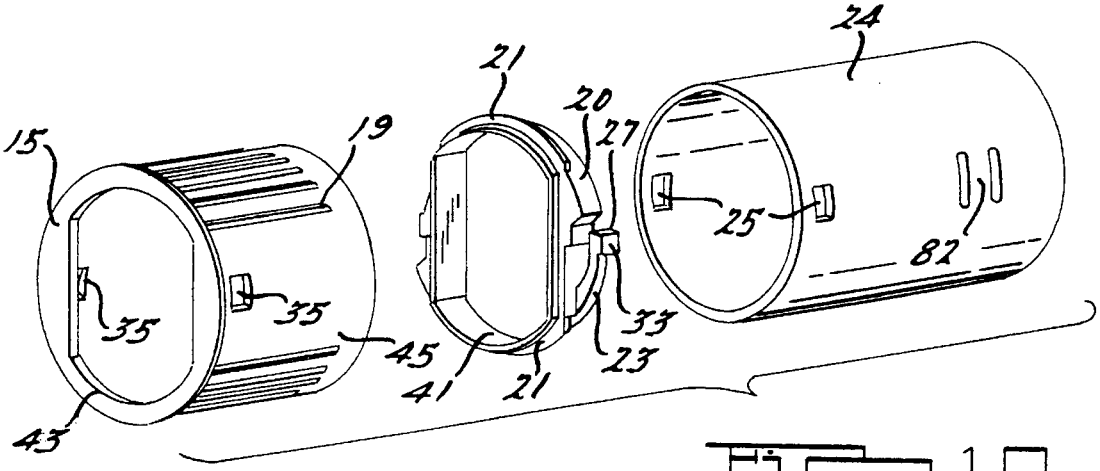
FIG. 10 is an exploded view showing a circular face plate interchangeable with the rectangular face plate shown in FIG. 4.
Figure 11:
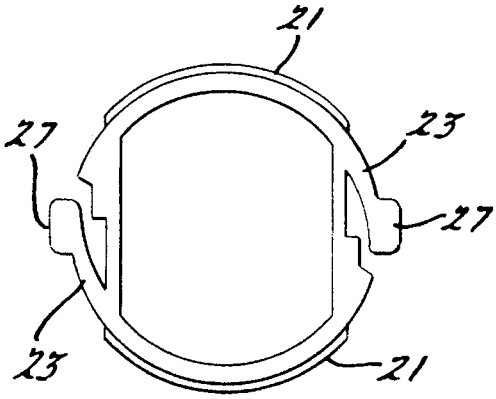
FIG. 11 is a rear elevation of the plastic guide showing the resilient fingers with snap tabs.
Figure 12:
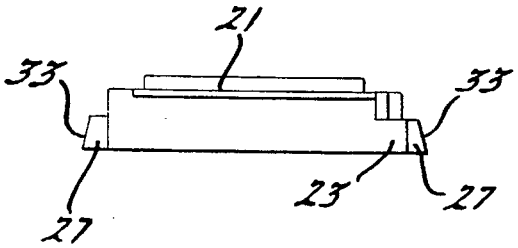
FIG. 12 is a top plan view of the plastic guide of FIG. 11.

If desired, a circular face plate member 15 may be interchangeably substituted for rectangular face plate 14. Referring to FIG. 10, circular face plate member 15 has a front opening 43 which corresponds to the configuration of bolt 18. A cylindrical body 45 telescopically receives the forward hollow cylindrical casing 24. A plurality of drive-in ridges are circumferentially spaced about the cylindrical body 45 to secure the latch bolt assembly 10 in the bore provided in the side edge of the door. The snap tabs 27 have ramps or chamfers 33 on their front surface to enable the hollow cylindrical body 45 to slide over forward casing 24 without dislodging the bolt guide 20 from the casing rectangular openings 25. The circular face plate member 15 is provided with rectangular apertures 35 disposed on opposite sides of the cylindrical body 45. With the apertures 35 aligned with apertures 25 the snap tabs 27 extend through apertures 25 into apertures 35 upon the circular face plate member being fully seated against the bolt guide 20.

In order to interchange one of the rectangular face plate member 14 or circular face plate member 15 for the other snap tabs 27 are squeezed inwardly to permit either sleeve 39 or cylindrical body 45 to be slidably removed from forward casing 24.

It should be noted that the central portion of bolt guide 20 is provided with a longitudinally extended bearing surface that matches the configuration of bolt 18. The longitudinally extended bearing surface 41 insures that the bolt will not fall out of whichever face plate 14 or 15 that may be used during change of the backset, despite possible variations in dimensional tolerances of the parts forming the bolt assembly 10.

The casing assembly 12 has a left rear casing half 30 and a right rear casing half 32 as shown in FIGS. 4 and 16. The rear casing halves 30, 32 are shells that are joined together to form a hollow cylinder that has a sliding fit relationship inside the forward latch casing 24 into which it is telescopically received. Back portions 34 of the rear casing halves 30, 32 are substantially rectangular in shape and have holes 36 positioned to align with the rotational axis 38 of the spindle 16. The rear casing halves 30, 32 are joined together to house a cam 40 therebetween. The cam 40 is provided with an integral hub 42 rotatably received within one or both of the axis holes 36 of the back portions 34. The hubs 42 each have a spindle slot 44 passing therethrough for the spindle 16. Thus rotation of the spindle 16 pivots the cam 40 about the rotational axis 38. Cam 40 has a side protrusion 46 that engages in an arcuate slot 48 in the back portion 34 of rear casing half 32. The combination of protrusion 46 and slot 48 constrains rotational movement of cam 40 between retracted and extended positions. A distal end of cam 40 engages opposite ends of a slot 50 formed at one end of bolt extension 52. Side flanges 54 on bolt extension 52 engage elongated longitudinal slots 56 formed in the back portions 34 of the rear casing halves 30, 32. Rotation of spindle 16 pivots cam 40 which in turn reciprocates bolt extension 52 with side flanges 54 sliding in the elongated slots 56.

FIGS. 1–4, 8 and 9 show the present invention with a solid bolt adjuster 62. The curved front end of bolt extension 52 fits into a curved or arcuate aperture 58 in a flange 60 of solid bolt adjuster 62. A pin 64 extends through a hole in flange 60, passes through a hole 66 in the end of bolt extension 52 thereby linking bolt extension 52 and bolt adjuster 62 together. Bolt adjuster 62 reciprocates with the bolt extension but neither bolt extension 52 nor bolt adjuster 62 are able to rotate because side flanges 54 are constrained by the longitudinally extending slots 56.

The arcuate slot 58 is slightly larger in all dimensions than the arcuate end of bolt extension 52. This provides a pivotal or universal link between the end of the bolt extension 52 and bolt adjuster 62 to further reduce the possibility of bolt jamming.

A helical groove 72 is provided on the cylindrical surface of bolt adjuster 62 extending at least 180° around the periphery thereof. The longitudinal distance of the groove 72 is equivalent to ⅜ inch or the dimensional difference between the short dimension backset and the long dimension backset. A notch 74 is provided at each end of groove 72, and a bolt guide pin 76 inserted through hole 78 in the end of bolt 18 engages in groove 72. The two notches 74 at each end of the groove provide positive positioning of bolt adjuster 62 in either the short dimension backset or the long dimension backset. Whereas a helical groove 72 is illustrated, the groove need not be helical but must permit longitudinal movement between bolt 18 and bolt adjuster 62 as well as rotational movement.

Figure 19:
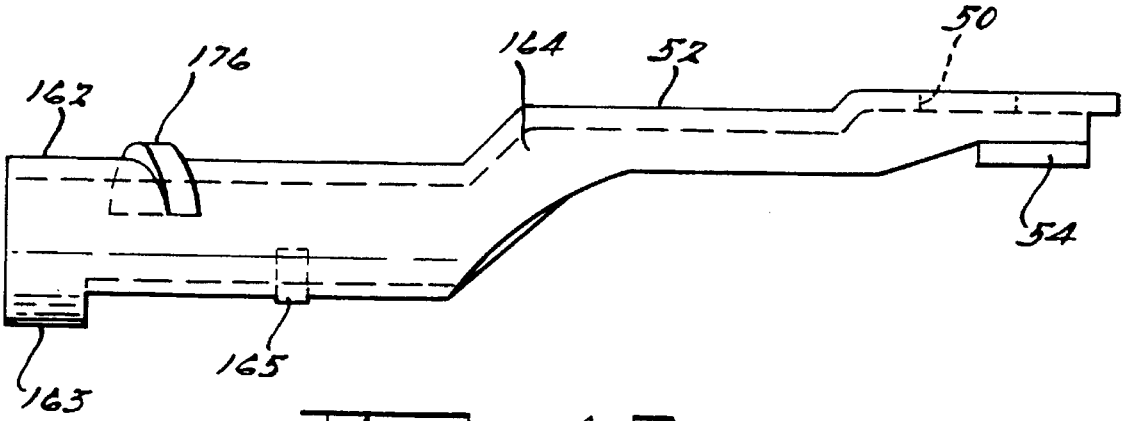
FIG. 19 is a greatly enlarged right side elevation of the one-piece adjuster and bolt extension.
Figure 20:
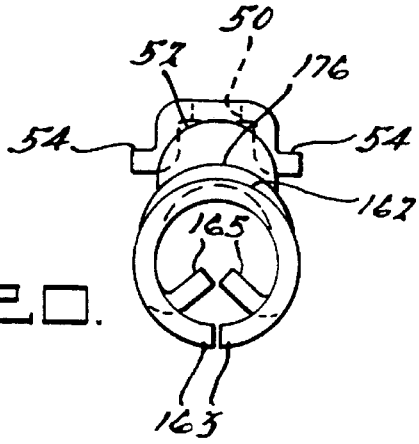
FIG. 20 is a front elevation of the one-piece bolt adjuster and bolt extension of FIG. 19.

FIGS. 13–20 show the present invention with a tubular bolt adjuster 162 formed at the forward end of and integral with bolt extension 52. The bolt adjuster 162 is offset radially inward from the bolt extension 52 and connected therewith by an angularly disposed interface section 164. The bolt extension 52 and bolt adjuster 162 may be stamped or otherwise formed from a common sheet of material. The forwardmost end of tubular bolt adjuster 162 is formed into a circular cylinder with opposed fingers 163 in contact with each other. Radially inwardly bent bridge members 165 are formed on the underside of the bolt adjuster 162 portion of the one-piece combination bolt adjuster/bolt extension as best seen in FIGS. 19 and 20.

An external projection 176 is provided on the cylindrical surface of tubular bolt adjuster 162. The external projection is threadably received in a helical groove 172 and is formed as an internal thread in the inner cylindrical surface of the cylindrical aperture or bore 70 of bolt 18 and extends at least 180° therewithin. The longitudinal distance of helical groove 172 is equivalent to the dimensional difference between the short dimension backset and the long dimension backset. An access opening 173 is provided at the rear end of the helical groove 172 to permit the external thread portion 176 of the bolt adjuster 162 to be received by the helical groove 172.

Bolt adjusters 62 and 162 each have a cylindrical surface with a sliding fit within a mated cylindrical aperture 70 in the bolt 18 as illustrated in FIGS. 3 and 15, respectively. This sliding and mating fit permits the bolt 18 to rotate and slide on bolt adjuster 62 or 162. The sliding and mating fit provides only minimum clearance which minimizes any sideways movement that otherwise could occur between the bolt 18 and bolt adjuster 62 or 162.

The rear casing halves 30, 32 when joined together, have a non-helical substantially serpentine shaped slot 80 which extends for at least 180° around the casing surface. The non-helical serpentine shaped slot 80 is illustrated in FIGS. 4 through 7. The longitudinal axial distance from end-to-end of non-helical slot 80 is the same as the longitudinal distance of the helical groove 72 in bolt adjuster 62. The cylindrical forward latch casing 24 has an inwardly directed protrusion 82 which may be formed by two cutouts and an indented portion punched therebetween which projects into the non-helical serpentine shaped slot 80 in the rear casing halves 30, 32. The non-helical serpentine shaped slot 80 provides circumferentially linear slot portions 81 at each end of the slot 80 and at the center where the rear casing halves 30, 32 join together. These three linear slot portions 81 extend transverse to the longitudinal direction of movement of the bolt.

The central linear slot portion 81 prevents the forward latch casing 24 from moving longitudinally as forward latch casing detent or protrusion 82 moves from one arcuate step to the other midway through the 180° rotation of forward latch casing 24 thereby causing the bolt 18 to move longitudinally ahead of the forward casing during change of backset. This eliminates the possibility of the bolt 18 falling out of the face plate 14 or 15.

The cam 40 has flat surfaces 86° at 90° to each other and a spring member 88 fits between the back portions 34 of the rear casing halves 30, 32 to provide a positive positioning of cam 40. Thus a positive positioning of cam 40 is achieved when bolt 18 is either in the extended position or in the retracted position. Location holes 89 in the back portions 34 of the rear casing halves 30, 32 are located on either side of axis holes 36 on the spindle axis 38 and are provided for attaching door knob assemblies, keylock assemblies and the like on both sides of the door for operating the latch assembly.

In an operation to change the latch assembly 10 from the short dimension backset as shown in FIG. 2 and FIG. 14 to the long dimension backset as shown in FIG. 3 and FIG. 15, it is necessary to rotate the forward latch casing 24 through 180° about the rear casing halves 30, 32. The protrusion 82 in the forward latch casing 24 engages with the non-helical serpentine shaped slot 80 in the rear casing halves 30, 32 and moves the forward latch casing 24 forward in two discrete arcuate steps between the three transverse linear slot portions for the required distance to extend the forward latch casing 24 from the short dimension back to the long dimension backset. At the same time the plastic guide 20 or the face plate 14 engages bolt 18 and rotates the bolt through 180° simultaneously with the rotational movement of the forward latch casing 24.

Referring to FIGS. 2 and 3, as the bolt 18 rotates about the solid bolt adjuster 62, the bolt guide pin 76 engages in groove 72 and bolt 18 moves outward for exactly the same distance that the forward latch casing 24 moves. The long dimension backset is shown in FIG. 3. The notches 74 in groove 72 provide positive positioning of the assembly when it is at either the short dimension backset or the long dimension backset.

Referring to FIGS. 14 and 15, as the bolt 18 rotates about the tubular bolt adjuster 162, the external thread 176 engages in the internal helical groove 172 and bolt 18 moves outward for exactly the same distance that the forward latch casing 24 moves. The long dimension backset is shown in FIG. 15.

The bolt 18 has a center point 90 at its front center. This center point 90 acts as an indicator for positioning a striker plate in a door frame. Once the latch assembly is mounted within the door, it is merely necessary to close the door, rotate the spindle 16 until bolt 18 protrudes outward and the center point 90 contacts and marks a location on the door frame which represents the center of the striker plate.

The latch assembly shown in the drawings is suitable for a deadbolt arrangement. However, the latch assembly may be used for other types of latch assemblies. This may be achieved by replacing the cam, adding a coil spring within the bolt adjuster 62 or 162 to engage on surfaces of the rear casing halves 30, 32 adjacent the back portions 34 to ensure there is always a spring action to force bolt 18 to the extended position. The shape of bolt 18 may be changed to a tapered face so the bolt is pushed inward when it contacts a striker plate, and then extends to the extended position to latch the door closed.

As well known in the art a hardened security roller (not shown) may be provided in a cavity formed in the solid bolt adjuster 62 or within the tubular bolt adjuster 162 for added security. If added to a cavity within the solid bolt adjuster 62, the hardened security roller is held in place by pin 64 within flange 60 (see FIG. 4). If added within the tubular bolt adjuster 162, the hardened security roller can be provided with a flange at its forward end to retain the security roller within the tubular bolt adjuster 162.

Although the invention has been described in detail in the foregoing for the purpose of illustration, it is to be understood that such detail is solely for that purpose and that variations can be made therein by those skilled in the art without departing from the spirit and scope of the invention of the appended claims.

We claim:

1. A latch assembly having a backset adjustment for mounting within a bore extending in from a side edge of a door and operable by a rotatable operator on a side of the door disposed for rotation about a rotational axis, the latch assembly comprising:

a casing assembly for mounting in the bore of a door, the casing assembly having a bolt assembly longitudinally reciprocal therein between a retracted position and an extended position;

the bolt assembly including a bolt with a cylindrical aperture therein, the bolt rotatable and reciprocal relative to a non-rotational bolt adjuster and having a sliding fit thereon, an internal groove extending for at least 180° within the cylindrical aperture of the bolt, the bolt adjuster having an external projection engageable in the groove of the bolt;

a bolt extension connected at one end with the bolt adjuster and reciprocal with the bolt assembly;

a cam actuating means connected to the other end of the bolt extension, the cam actuating means having a pivot connection coaxial with the rotational axis of the rotatable operator;

the casing assembly including a rear casing with a back portion containing retaining means for rotatably constraining the cam actuating means, the back portion of the rear casing integral with a front hollow cylindrical portion with a non-helical substantially serpentine shaped slot extending about a portion of the circumference thereof;

a forward hollow cylindrical casing rotatable and slidable about the front portion of the rear casing, the forward casing having an internal protrusion engageable in the non-helical substantially serpentine shaped slot of the front portion of the rear casing; and the forward casing engaging the bolt with the forward casing and bolt simultaneously rotatable through significantly different patterns of movement at least 180° to change the backset.

2. The latch assembly according to claim 1 including a face plate attached to the forward hollow cylindrical casing for mounting on the side edge of the door, the face plate having attachment holes in line with an aperture in the face plate for the bolt, the face plate and forward hollow cylindrical casing being rotatable such that the attachment holes in the face plate may be attached to the side edge of the door for either backset.

3. The latch assembly according to claim 2 including a plastic guide between the face plate and the forward casing, the plastic guide providing a sliding surface for reciprocal movement of the bolt.

4. The latch assembly according to claim 2 wherein the bolt has flat sides to engage with flat sides in the aperture in the face plate for the bolt, such that rotation of the face plate and forward casing relative to the rear casing simultaneously rotates the bolt relative to the bolt adjuster to change the backset.

5. The latch assembly according to claim 1 wherein the bolt has a centering point at its center for marking an adjacent frame for positioning a striker plate.

6. The latch assembly according to claim 1 wherein the internal groove within the cylindrical aperture of the bolt is helical.

7. The latch assembly according to claim 1 wherein the bolt adjuster is tubular and formed in common with the bolt extension at one end thereof.

8. The latch assembly according to claim 7 wherein the forward end of the bolt adjuster is cylindrical.

9. The latch assembly according to claim 8 wherein the cylindrical forward end of the bolt adjuster is formed by opposed fingers.

10. The latch assembly according to claim 1 wherein the rear casing is made in two halves and the substantially non-helical serpentine shaped slot in the rear casing extends across both halves.

* * * * *